United States Patent [19]

Martin et al.

[11] Patent Number: 5,006,195

[45] Date of Patent: Apr. 9, 1991

[54] APPARATUS FOR FOLDING AND SEALING A FORM ALONG A TRANSVERSE EDGE

[76] Inventors: Samuel W. Martin, Martin Rd., Weston, Conn. 06883; Steven A. Supron, 11 Comstock Hill Ave., Norwalk, Conn. 06850

[21] Appl. No.: 407,488

[22] Filed: Sep. 14, 1989

[51] Int. Cl.[5] ..... B43M 5/04

[52] U.S. Cl. ..... 16/442.1; 156/443; 156/578; 493/421; 118/246; 118/258; 118/260

[58] Field of Search ..... 493/420, 421; 156/442.1, 578, 443, 441.5; 118/244–246, 258, 260, 268

[56] References Cited

U.S. PATENT DOCUMENTS

| | | | |
|---|---|---|---|
| 2,374,076 | 4/1945 | Burckhardt et al. | 137/575 |
| 4,834,669 | 5/1989 | Martin | 493/420 X |
| 4,875,965 | 10/1989 | Marzullo | 493/420 X |

*Primary Examiner*—Michael W. Ball
*Assistant Examiner*—Jeff H. Aftergut
*Attorney, Agent, or Firm*—Robert H. Whisker; Melvin Scolnick; David E. Pitchenik

[57] ABSTRACT

Apparatus for printing, folding, and sealing a one-piece form sheet to prepare a self-mailer. The apparatus includes a substantially conventional printer, which may be a laser printer, suitable for use with a personal computer. The printer is mounted above and outputs printed form sheets downwards to a folder sealer for folding and sealing to prepare a self-mailer. The folder sealer includes a folder having a central and peripheral rollers and curved, one-sided, open buckle chutes for folding the form sheet and delivering it to a transport which extends under the printer. The folder sealer also includes moistening apparatus for moistening areas on the form sheet to which a remoistenable glue has been applied.

14 Claims, 13 Drawing Sheets

APPARATUS FOR FOLDING AND SEALING A FORM ALONG A TRANSVERSE EDGE

RELATED APPLICATIONS

This application is one of the following group of co-pending, commonly assigned, applications, which were all filed on even date. These applications all relate to the development of an apparatus for printing, folding, and sealing a form sheet to prepare a self-mailer.

| Ser. No. | Title | Inventor | Attorney Docket No. |
|---|---|---|---|
| 407,391 | Moistening Apparatus | S. Supron | C-571 |
| 407,488 | Apparatus for Folding and Sealing a Form Along a Transverse Edge | S. Martin<br>S. Supron | C-572 |
| 407,501 | Apparatus for Folding a Form Sheet | S. Martin<br>S. Supron | C-573 |
| 407,583 | Apparatus for Preparing a Self-Mailer | S. Martin | C-574 |
| 407,400 | Apparatus Having a Diverter Responsive to Jams for Preparing a Self-Mailer and Method of Operating Same | D. Long<br>S. Martin | C-575 |

BACKGROUND OF THE INVENTION

This invention relates to apparatus for folding a sealing a form. More particularly, it relates to apparatus, including a curved, one-sided, open buckle chute for folding and sealing a form along a transverse edge.

Self-mailers, that is form sheets on which may be printed address information and message information and which then may be folded and sealed to form a mail piece, are well known. A preferred version of such a form sheet is described further below, and in commonly assigned, co-pending application Ser. No. 356,149, filed May 24, 1989. Another is described in U.S. Pat. No. 3,995,808; to: Kehoe; for: UNIT CONTAINING VARIABLE MESSAGES; issued: Dec. 7, 1976. As may be seen by examination of each of these form sheets, in order to achieve complete sealing, it is necessary to apply an adhesive fluid, e.g. water to moisten a remoistenable glue, along a transverse edge of the form sheet.

In commonly assigned, co-pending application Ser. No. 115,220; filed: Oct. 30, 1987 an apparatus for folding and sealing a form sheet is shown. In this apparatus, a straight, two-sided, closed buckle chute is shown in combination with a moistening apparatus. The moistening apparatus includes a plurality of units each of which has a pivotable hammer for pressing a form sheet against a moistened wick as the form sheet is withdrawn from the buckle chute.

It should be noted that because of the closed nature of the buckle chutes, the mechanically complex pivotable hammer arrangement is necessary to manipulate the form sheet within the buckle chute to assure adequate moistening. It should also be noted that the disclosed apparatus is not capable of moistening the form sheet along the transversed edge, but instead, provides a plurality of units for moistening a plurality of spots near the transverse edge but, which do not provide a continuous seal along the transverse edge; and that frictional forces created as the hammers force the form sheet against the wicks create tension in the form sheet, which may cause pre-formed tear lines to prematurely separate.

Another apparatus for folding and sealing sheets is disclosed in U.S. Pat. No. 4,701,233; to: Beck et al.; for: METHOD FOR FOLDING AND SEALING SHEETS; issued: Oct. 20, 1987, which discloses an apparatus for use with a facsimile system to assure privacy of a received facsimile document. The facsimile document is output to a folder sealer system which folds the document so that only an address portion is visible and seals the document by injection of glue dots along the lateral edges.

Accordingly, it is an object of the subject invention to provide an apparatus for folding and sealing a form sheet along a transverse edge which is both mechanically simple and efficient.

It is another object of the subject invention to provide such an apparatus which minimizes the increase in the tension forces in the form sheet as the apparatus is moistened so as to minimize the stress on any preformed tear lines which may be provided in the form sheet.

BRIEF SUMMARY OF THE INVENTION

The above objects are achieved, and the disadvantages of the prior art are overcome in accordance with the subject invention by means of an apparatus which includes a folder for folding a form sheet so that the leading and trailing edges of the form sheet are super imposed and in contact, and an apparatus for applying an adhesive fluid, which is preferably water to remoisten a remoistenable glue, previously applied to the form sheet, positioned adjacent to the concave side and to the stop of a buckle chute. The buckle chute is a curved, one-sided buckle chute opened towards its concave side.

In a preferred embodiment of the subject invention, the apparatus for applying adhesive fluid further includes a primary reservoir, a roller positioned to tangential contact with the form sheet as the form sheet moves transversely across the roller, a trough surrounding the lower portion of the roller, and a capillary tube connecting the primary reservoir and the trough for maintaining an meniscus of water in the trough; so that as said form sheet moves across the roller, the roller rotates through the meniscus to transfer a film of water to the form sheet.

Thus, it may be seen that the subject invention advantageously overcomes the disadvantages of the prior art; particularly in that contact between the form sheet and the moistening apparatus is low friction, rolling contact between the form sheet and the roller which minimizes the tension forces necessary to draw the form sheet across the roller. Other objects and advantages of the subject invention will become apparent to those skilled in the art from consideration of the attached drawings and the detailed description set forth below.

DETAILED DESCRIPTION OF PREFERRED EMBODIMENTS

Figure 1:
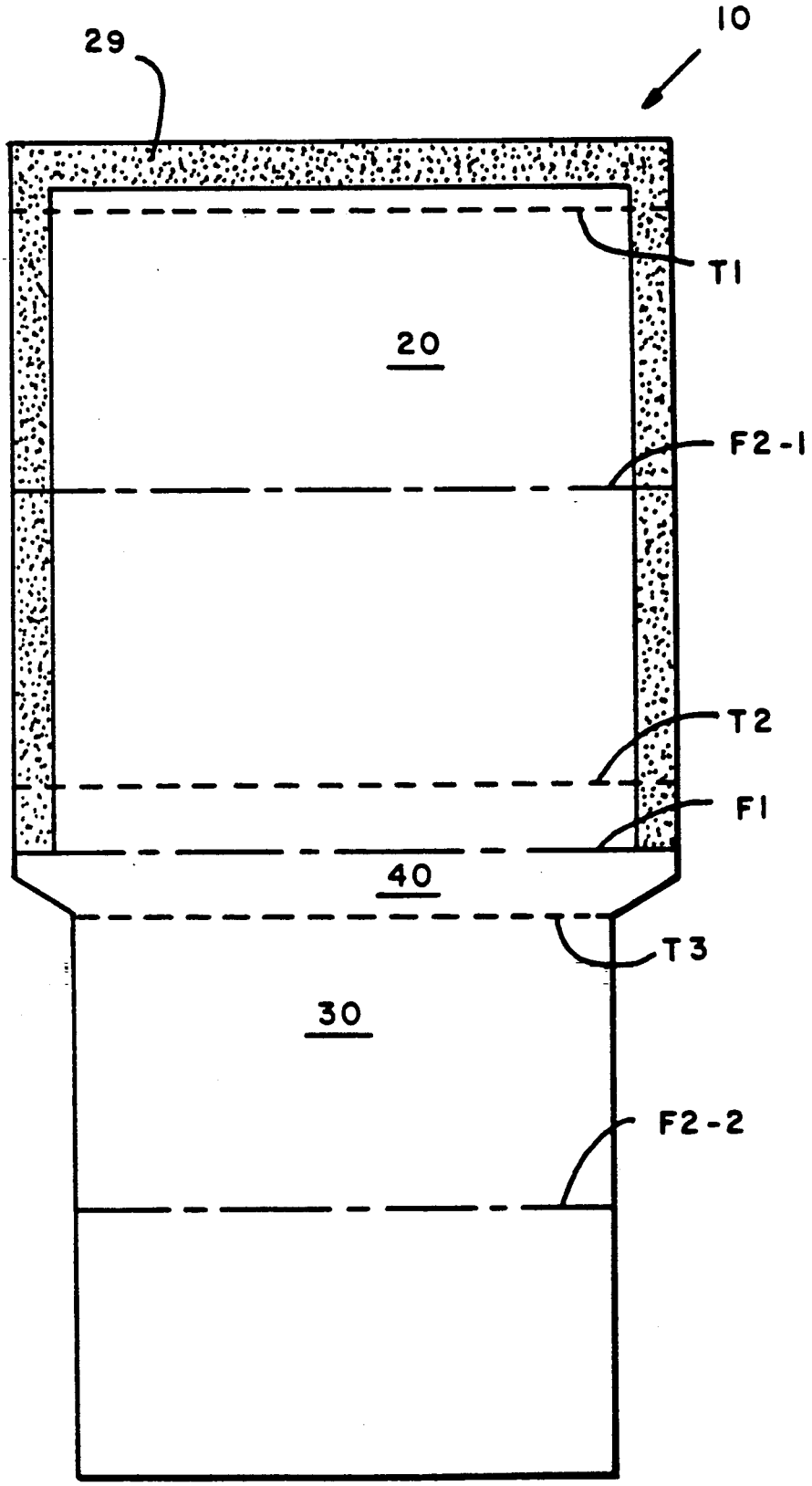
FIG. 1 shows the obverse side of a one piece form sheet which may be printed, folded, and sealed to prepare a self-mailer by apparatus in accordance with the subject invention.

FIG. 1 shows a plan view of the obverse side of a form sheet 10, which apparatus in accordance with the subject invention may print, fold and seal to prepare a self-mailer, as will be described further below. Form sheet 10 is described in more detail in the above mentioned commonly assigned, co-pending application Ser. No. 356,149. Form sheet 10 includes a substantially rectangular upper portion 20 bounded at its lower edge by a fold line F1. Upper portion 20 also includes a second transverse fold line F2-1 parallel to line F1 and connecting the mid-points of its lateral edges. Form 10 is weakened in portion 20 by tear lines T1 and T2 located parallel to and equally spaced below the upper edge of portion 20 and fold line F1.

Adhesive 29 is applied in a strip adjacent to the lateral and upper edges of portion 20 to seal form 10 after folding, as will be described further below.

Form 10 also includes a lower portion 30 for printing message information. At its upper edge, lower portion 30 is connected to connecting portion 40 along tear line T3 and also includes fold line F2-2 connecting the mid-points of the lateral edges of portion 30.

Connecting portion 40 extends from fold line F1 to tear line T3 to connect upper portion 20 and lower portion 30.

Figure 2:
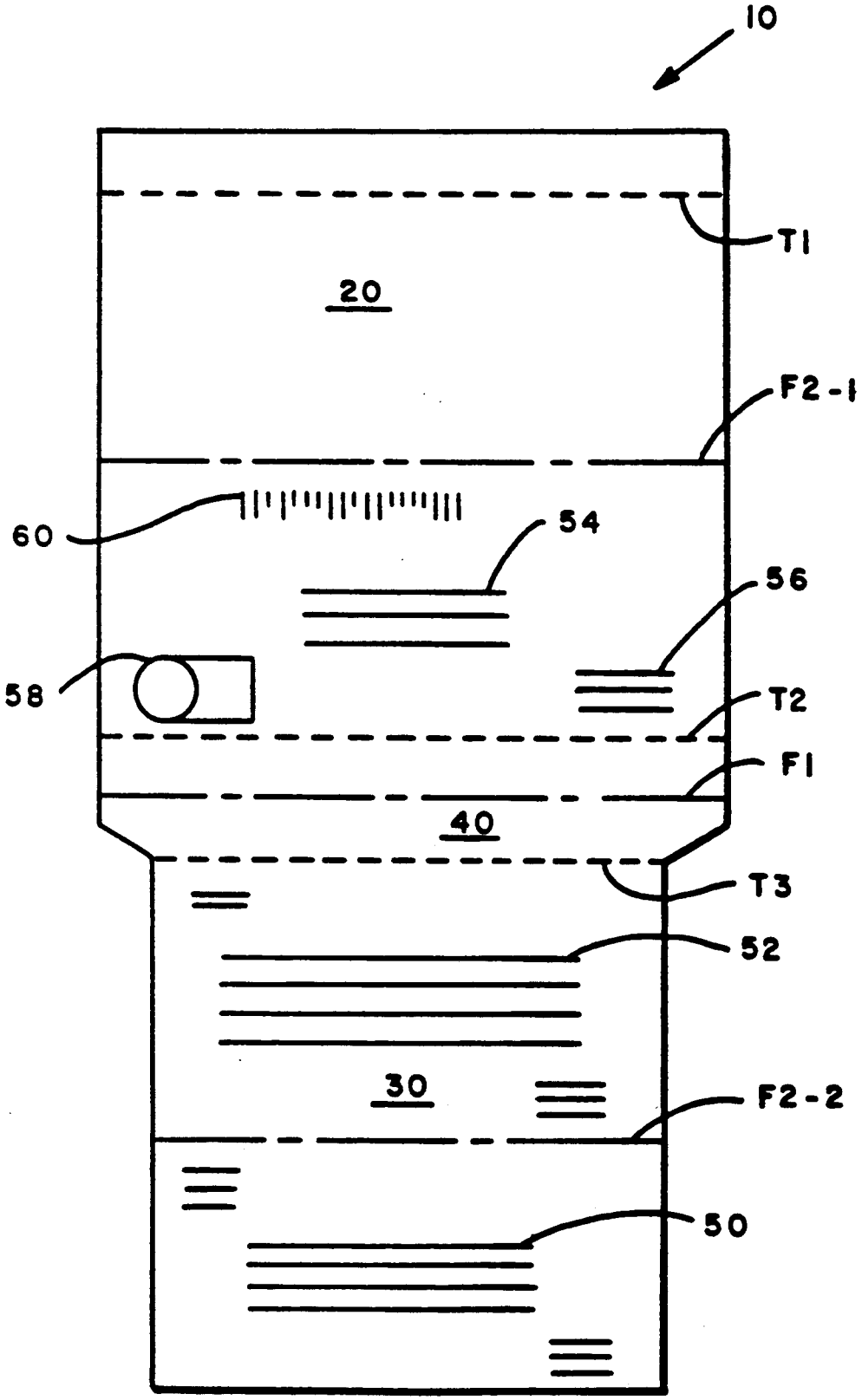
FIG. 2 shows the reverse side of the form sheet of FIG. 1.

FIG. 2 shows the reverse side of form 10. Lower portion 30 is printed with message information 50,52 on the reverse side. For example, message information 50 may be a bill or invoice, and message information 52 may be information for a return portion to be returned with payment. Upper portion 20 is printed between fold line F2-1 and tear line T2 with address information 54 and return address information 56, franking information 58, such as a penalty mail permit number, and bar code information 60 to facilitate handling by the postal service.

Figure 3:
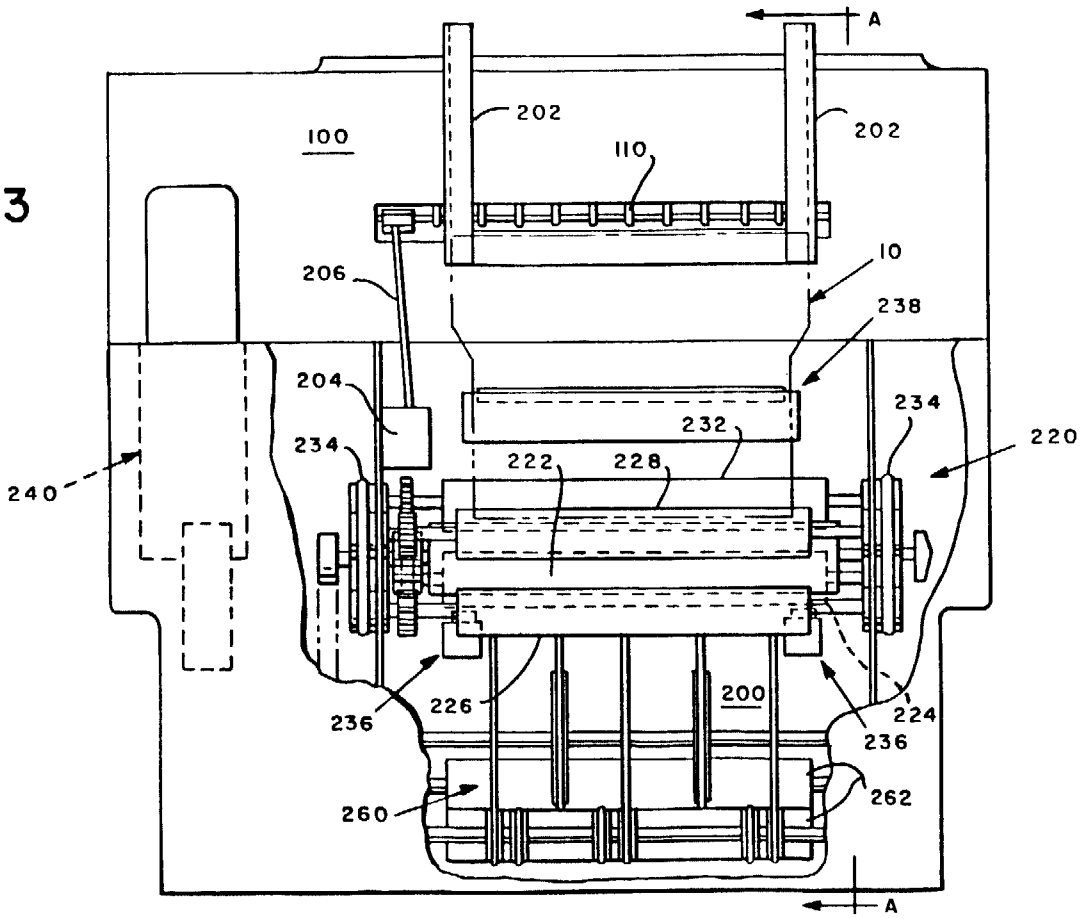
FIG. 3 shows a rear elevation, partially broken away, of apparatus in accordance with the subject invention.
Figure 4:
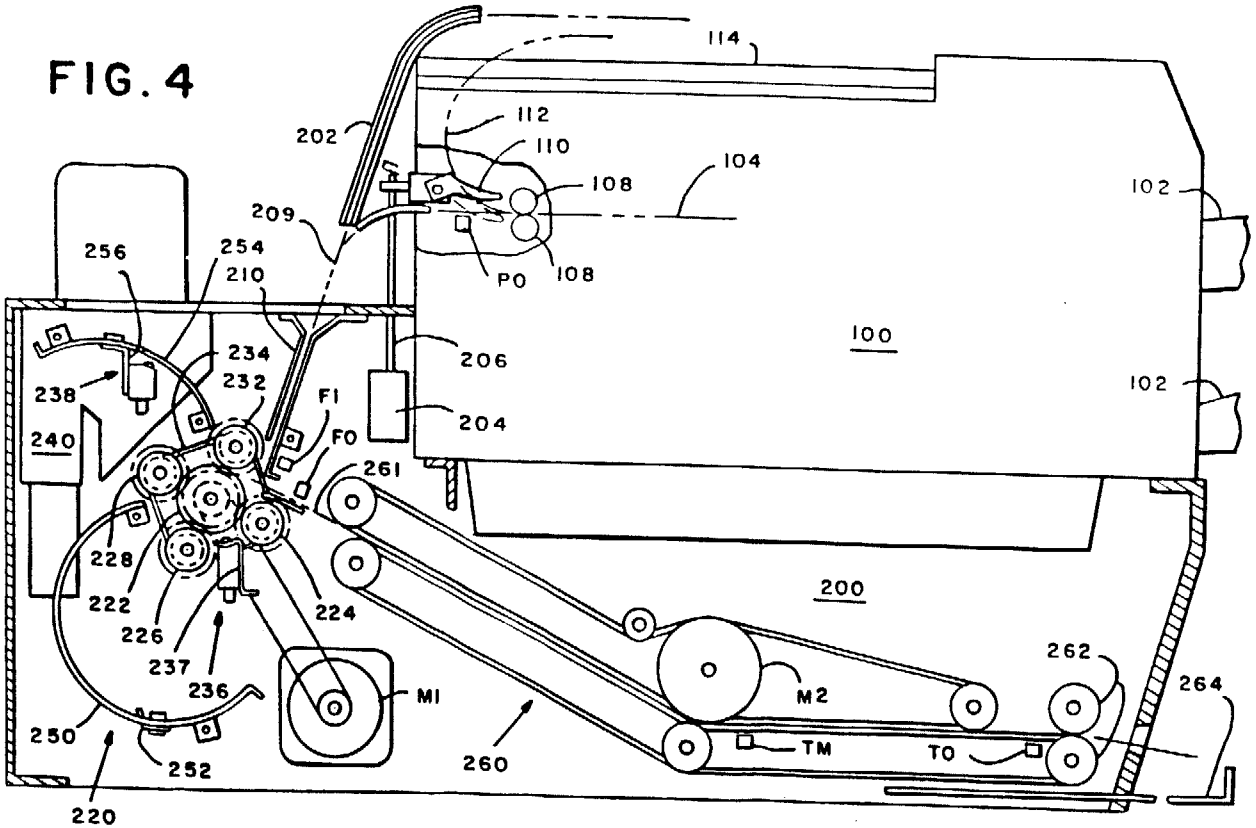
FIG. 4 shows a section taken along lines A—A of the apparatus of FIG. 3.

Turning to FIGS. 3 and 4, a preferred embodiment of the subject invention is shown. This embodiment is shown and used with substantially conventional printer of the type which is known for printing output from a personal computer, and preferably is a laser printer such as those manufactured by the Hewlett-Packard Company under the trade name "Laser Jet". As will be described further below, minor modifications have been made to printer 100 to facilitate its incorporation into the described embodiment of the subject invention. Other than these modifications, the operation of printer 100 is conventional and well understood. Accordingly, only details of the operation of printer 100 necessary for an understanding of the subject invention will be describe further.

Assuming that a form sheet 10 is selected and printed, in a conventional manner, with information as shown in FIG. 2; after printing form sheet 10 is urged along path 104 by final rollers 108 to exit printer 100 below deflector 110, which is shown in a raised position. If standard letter stock is selected, or if a jam is detected, deflector 110 is switched to its lower position to output a sheet along path 112 to upper output tray 114.

Printer 100 also includes a conventional sensor PO, to detect when form 10 is output by printer 100 and clear of rollers 108.

As it is printed by printer 100 form sheet 10 progresses to folder-sealer 200 for preparation as a self-mailer.

In order to adapt to printer 100, printer 100 is modified by the addition of manual input guides 202 for manual input of form sheets 10 to folder-sealer 200 and by adapting diverter 110 for control by solenoid 204 and operating shaft 206.

As form sheet 10 is output by printer 100, it is guided along path 209 by guides 210 to folding apparatus 220.

Folding apparatus 220 includes a central roller 222, preferably formed from an elastomer, around which are arranged in peripheral contact a first, alignment roller 224, which captures and aligns form sheet 10 in a known manner; a second, urge roller 226; a first, fold roller 228, which folds form sheet 10 along line F1; and a final fold roller 232, which folds form sheet 10 along lines F2-1, -2. Rollers 224, 226, 228, and 232 are held in tangential contact with central roller 222 by a conventional garter spring 234 and are conventionally mounted to allow radial displacement against the restoring force of spring 234 as form sheet 10 passes through folder 220. Preferably the circumference of central roller 222 is greater than the length of the self-mailer after folding so as to avoid interference between the leading and trailing edges of form sheet 10.

Mechanisms 236 and guide 237 are positioned between rollers 224 and 226 to seal the lateral edges of upper portion 20 of form sheet 10 as it is folded to prepare a self-mailer. Guide 237 extends between mechanisms 236 to form rolling loop L (FIG. 8) in form sheet 10, as will be described below. In the embodiment shown, mechanisms 236 are moisteners for moistening glue strip 29 along the lateral edges of upper portion 20, but it is also within the contemplation of the subject invention that form sheet 10 may be sealed by the application of other adhesive fluids, such as a glue, during the folding and sealing process, or by other means.

In accordance with the subject invention, sealing apparatus 238 is provided adjacent buckle chute 254 to seal the upper, transverse edge of upper portion 20 of form sheet 10. Water for sealing mechanisms 236 and 238 is provided by fluid supply system 240.

Reservoir 240 maintains two separate hydrostatic heads for sealing mechanisms 236 and 238, which are at separate heights, in a conventional manner which is described in U.S. Pat. No. 2,374,076; to Burckhardt et al., which is hereby incorporated by reference.

After passing sealing mechanism 236, form sheet 10 is urged by roller 226 into buckle chute 250 until it reaches stop 252, and buckles and is captured by the nip of first, fold roller 228 which folds form sheet 10 and urges it into buckle chute 254 until it reaches stop 256 and buckles into the nip of final, fold roller 232 for final folding.

Folder 220 also includes sensor FI to detect the input of form sheet 10 and sensor FO to detect the output of form sheet 10, and is driven by motor M1.

After final folding, form sheet 10, which is now folded and sealed to prepare a self-mailer, is urged by final roller 232 to transport mechanism 260 which transports form sheet 10 along a path extending below printer 100. Transport 260 is driven by motor M2 at a speed selected to allow sufficient time for adhesive 229 to adhere securely. This is achieved by operating transport 260 at a speed slower than the printing speed of printer 100, and providing a length great enough so that transport 260 may contain two or more mail pieces simultaneously. Transport 260 also includes final squeeze rollers 262, to assure a good seal of form 10, and sensors TM and TO.

After folding and sealing and transport form 10 is output as a self-mailer into lower output tray 264.

Figure 5:
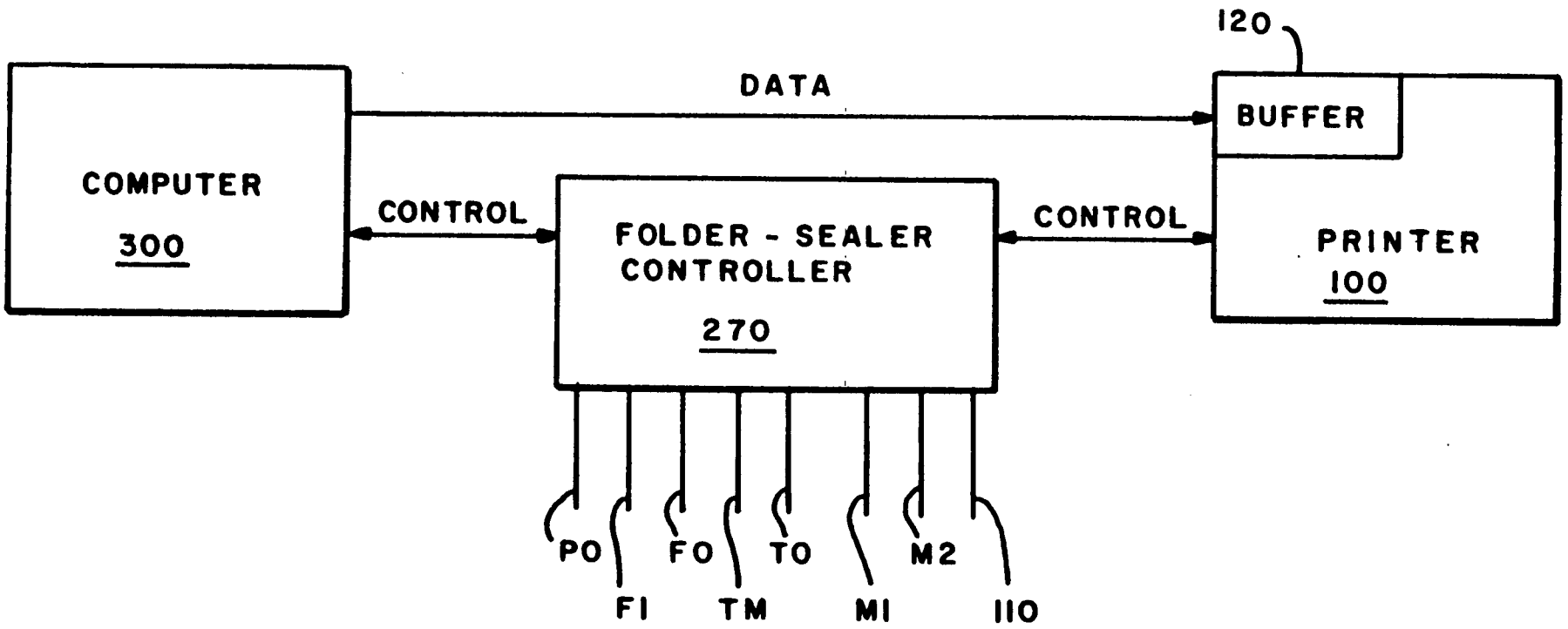
FIG. 5 shows a schematic block diagram of a control system for apparatus in accordance with the subject invention.

FIG. 5 shows a schematic block diagram of the control used with the system of the preferred embodiment of the subject invention. Controller 270 intercepts control signals between printer 100 and computer 300. Controller 270 also receives inputs from sensors PO,FI,-FO,TM, and TO. Controller 270 monitors the control signals exchanged between printer 100 and computer 300 to determine when a copy of a form sheet 10 is to be printed and otherwise passes the signals without modification so that printer 100 is controlled by computer 300 in a purely conventional manner as is well understood by those skilled in the art. It should also be noted that computer 300 transfers data for one or more pages of text to be printed by printer 100 to printer buffer 120. When controller 270 determines that a copy of form 10 is to be printed and prepared as a self-mailer it responds to inputs from sensors PO,FO,FI,FO,TM, and TO to control motors M1 and M2, and deflector 110 through solenoid 204 to operate folder sealer 200 as will be described below.

Figure 6:
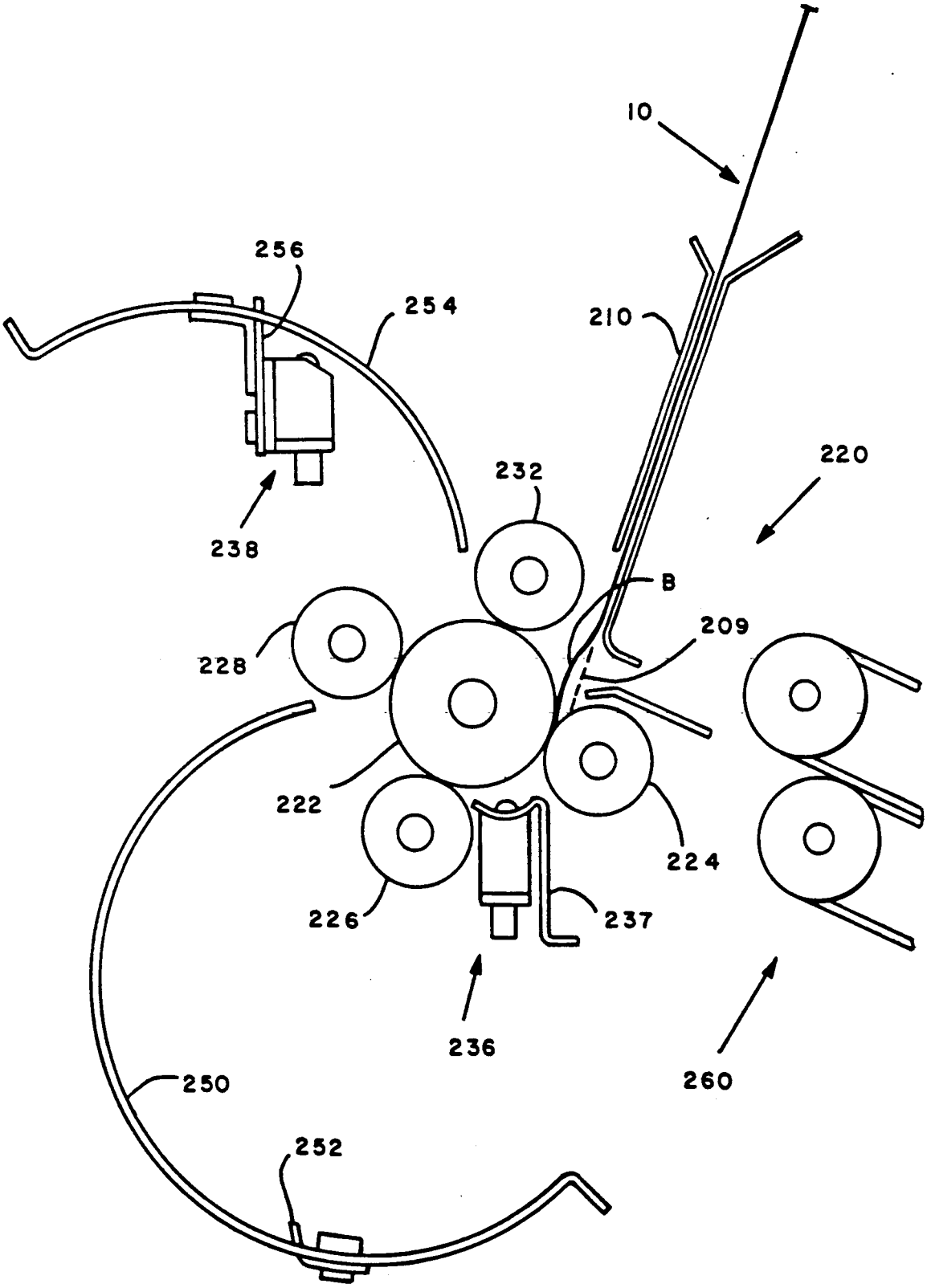
FIGS. 6–8 show a schematic representation of a portion of the operation of apparatus in accordance with the subject invention.

Turning now to FIGS. 6–13, the operation of folder 220 will be described in further detail. In FIG. 6 form 10 advances along path 209 guided by guide 210 until it encounters the circumference of roller 224. Form 10 then slides across the circumference of roller 224 until it is engaged in the nip formed between roller 224 and central roller 222. At this time folder 220 is jogged to engage the leading edge of form 10 in the nip between rollers 222 and 224, assuring that the leading edge of form 10 is aligned parallel to the axis of rollers 222 and 224, in a conventional alignment operation well known to those skilled in the arts.

Figure 7:
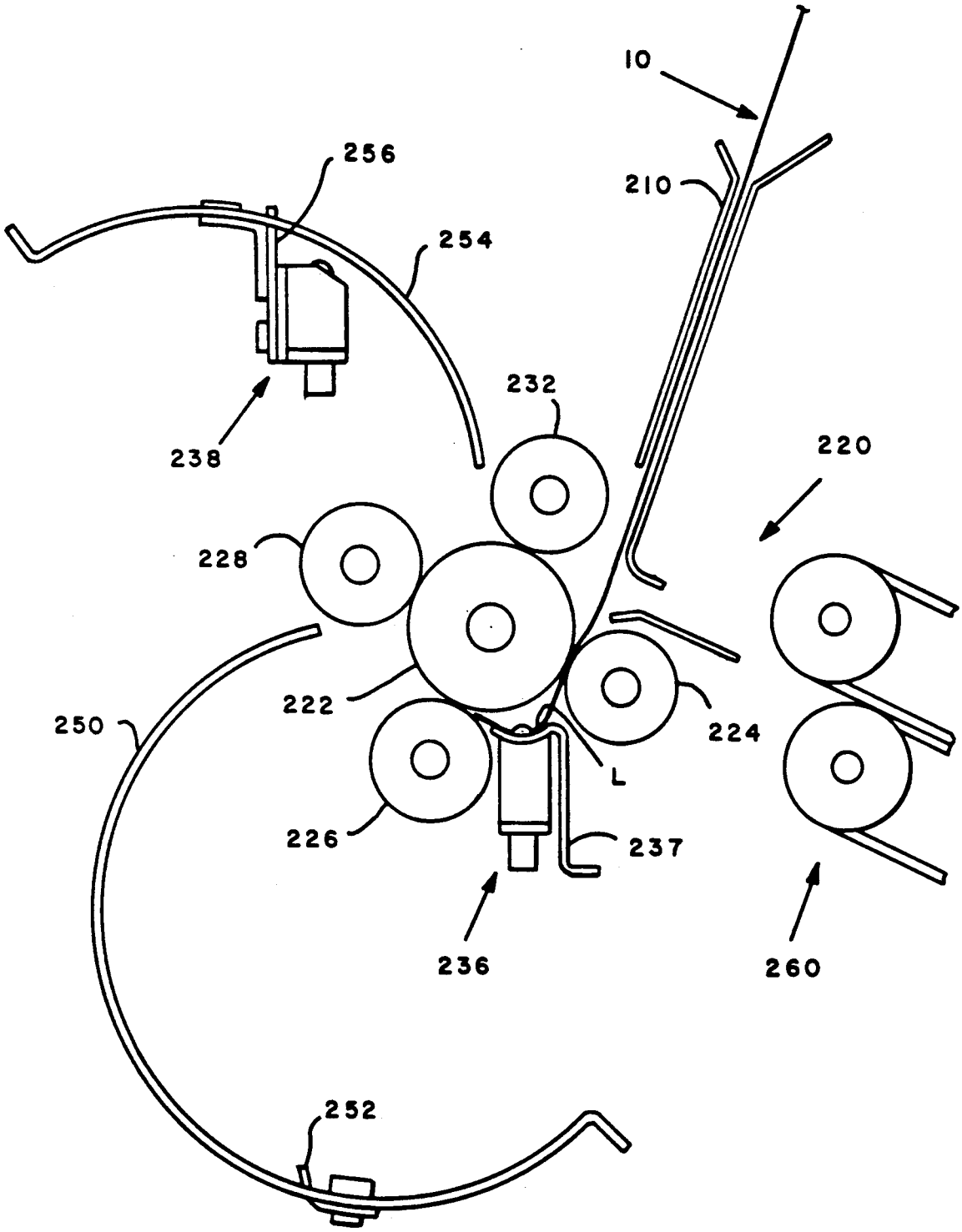

FIG. 7 shows the next step in the folding and sealing operation which begins after form 10 is clear from rollers 108. At this time, folder 220 begins continuous operation and form 10 advances until it contacts guide 237 between moisteners 236 where it is deflected by guide 237 into the nip formed by roller 226 and central roller 222 which urges form 10 into buckle chute 250. Note that form 10 is fed with lower portion 30 leading so that while it is deflected by guide 237, no moistening action takes place until upper portion 20 advances across moisteners 236.

Buckle chutes 250 and 254 are preferably opened, curved, one-sided buckle chutes, as described in U.S. Pat. No. 4,834,699, which is hereby incorporated by reference.

Figure 8:
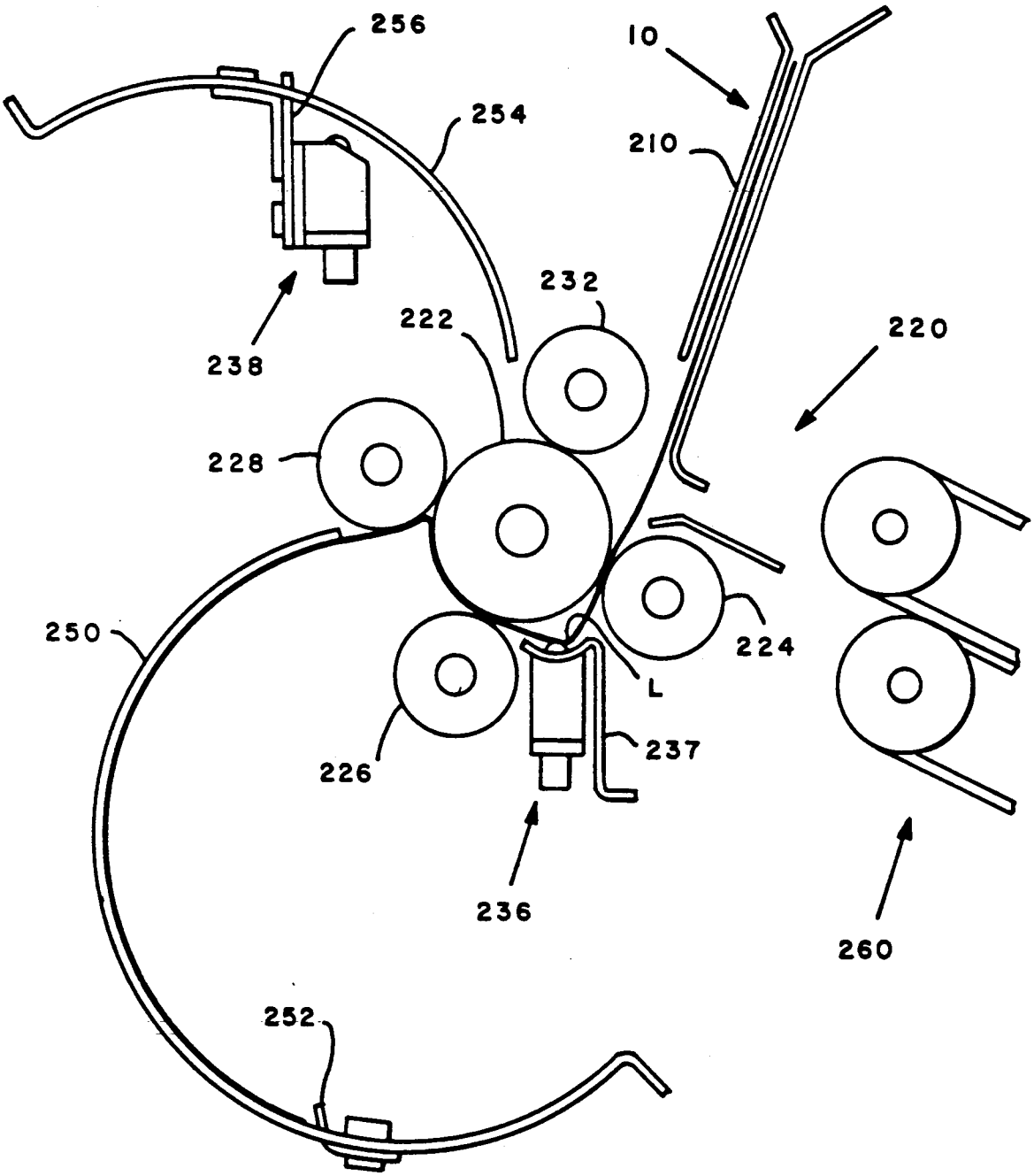
Figure 9:
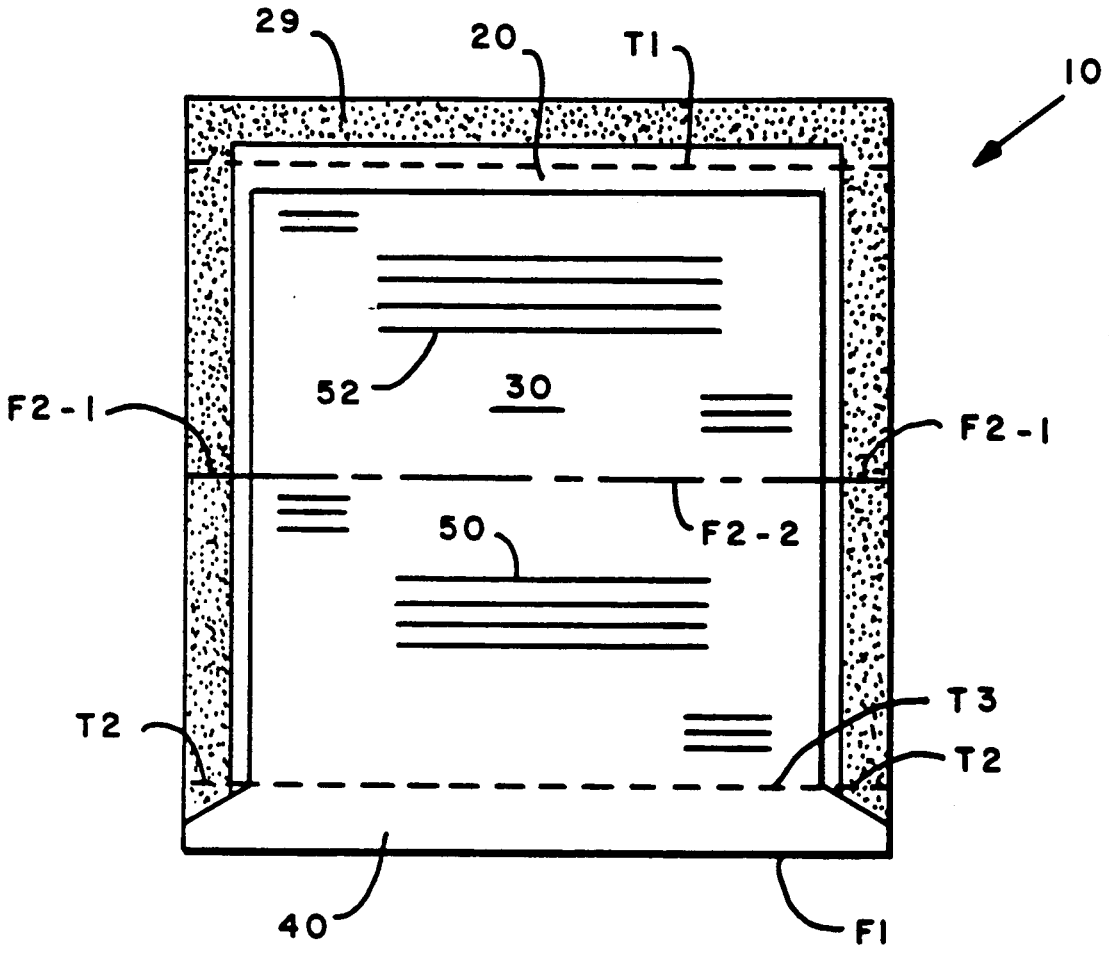
FIG. 9 shows the form sheet of FIGS. 1 and 2 after the operation of FIGS. 6–8.

FIG. 8 shows form 10 urged into buckle chute 250 by roller 226 until the leading edge reaches stop 252. Just prior to this point upper portion 20 has reached moisteners 236 and moisture is being applied to adhesive 29 along the lateral edges of upper portion 20. Roller 226 continues to urge form 10 against stop 252 until form sheet 10 buckles at fold line F1 into the nip formed by rollers 228 and 222. At this point form sheet 10 has been folded once along fold line F1, as is shown in FIG. 8, with the obverse sides of upper portion 20 and lower portion 30 in contact.

Figures 10, 10A, 10B:
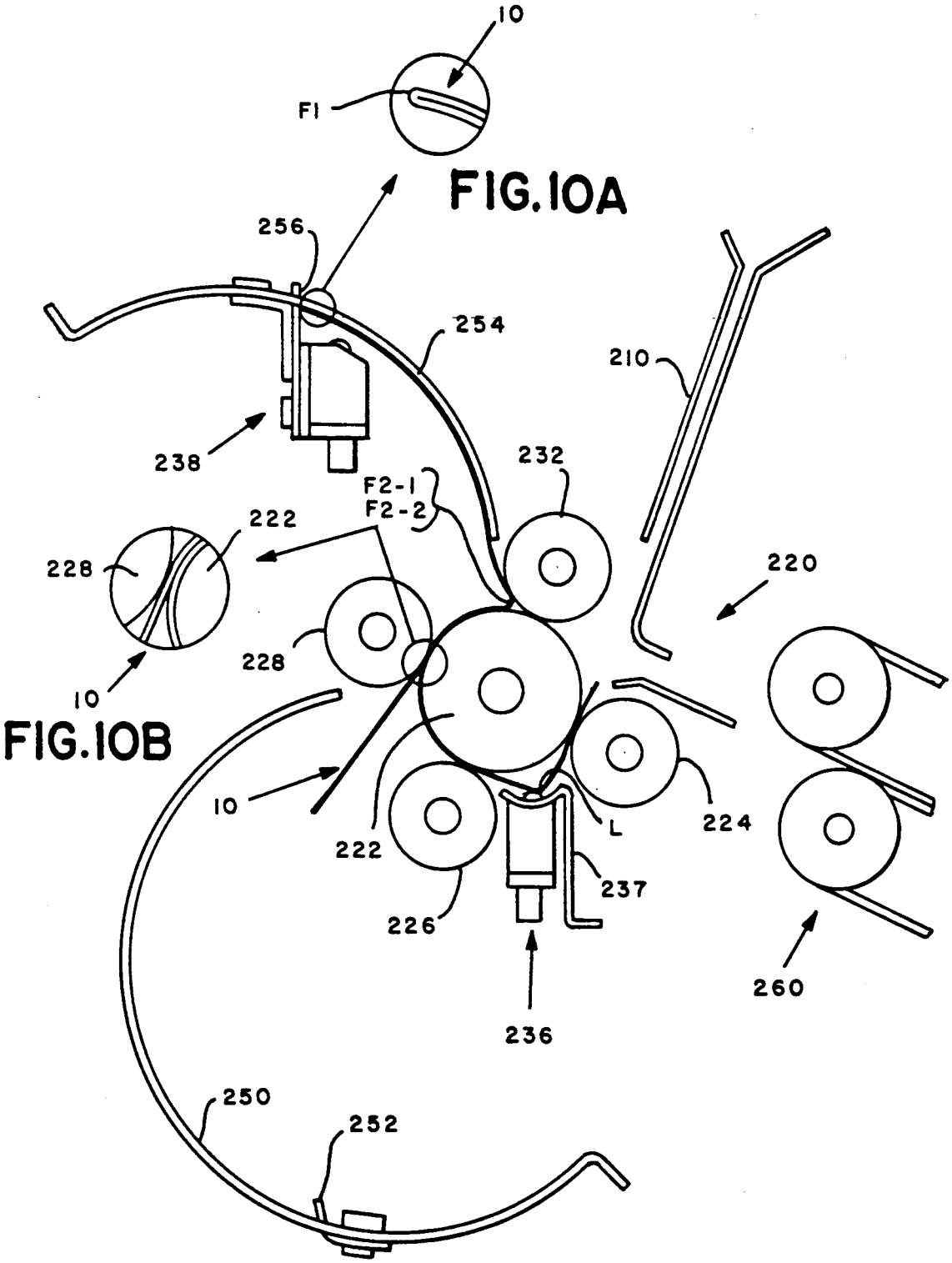
FIGS. 10, 10A, 10B, 11, 11A, 12, and 12A show the following portion of the operation of apparatus in accordance with the subject invention.

In FIGS. 10, 10A, and 10B roller 228 continues to urge form 10, now folded once, into buckle chute 254 until the leading edge, i.e. fold line F1, reaches stop 256. As roller 228 continues to urge form sheet 10 against the resistance of stop 256, portions 20 and 30 of form sheet 10 buckle into the nip formed between central roller 222 and roller 232 at fold lines F2-1 and F2-2.

Figures 11, 11A:
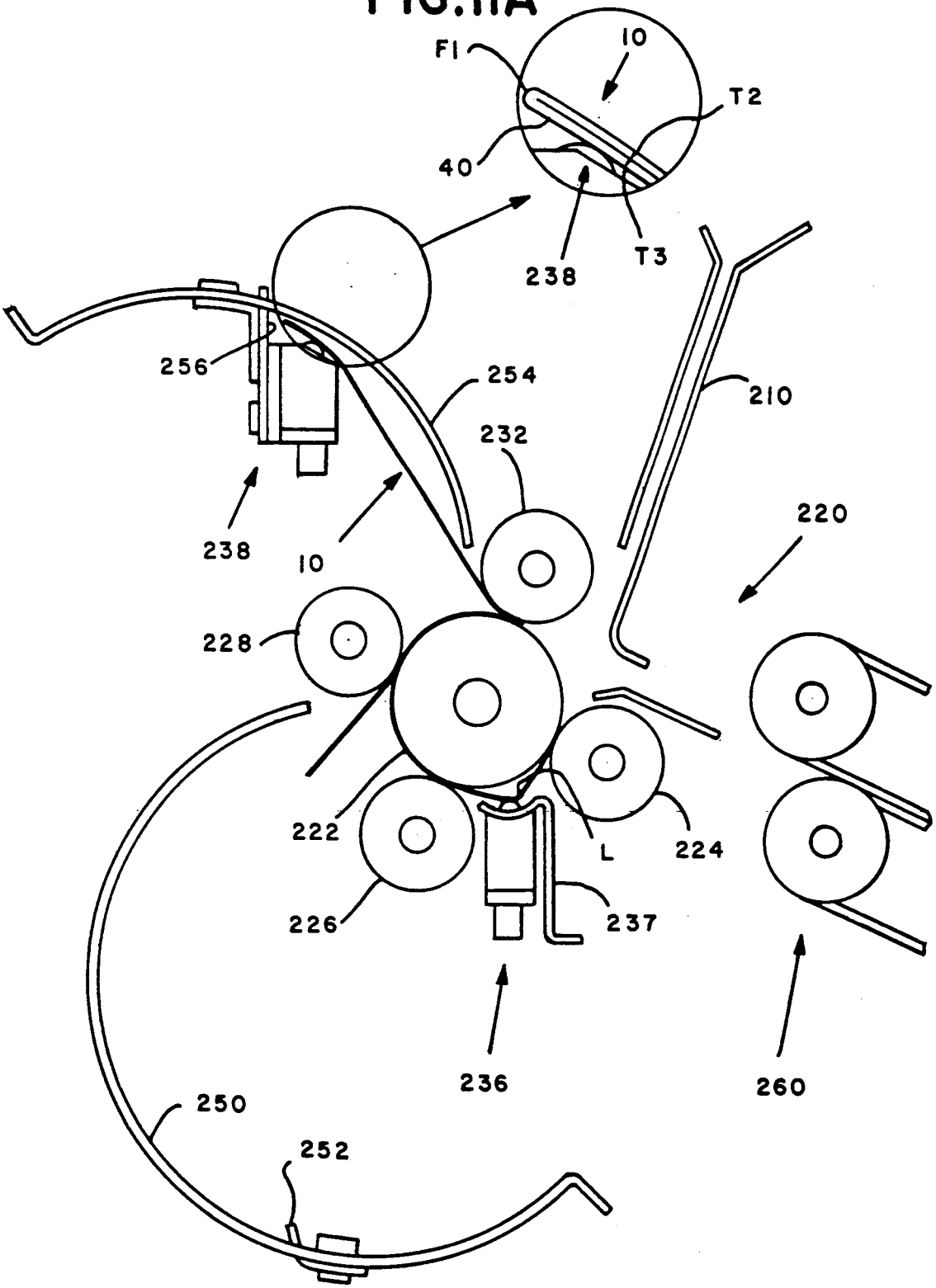

In FIGS. 11 and 11A, in accordance with the subject invention, form sheet 10 is captured by rollers 232 and 222 and drawn away from the concave surface of buckle chute 254 and into contact with moistener 238 so that moisture is applied across the length of connecting portion 40.

Figures 12, 12A:
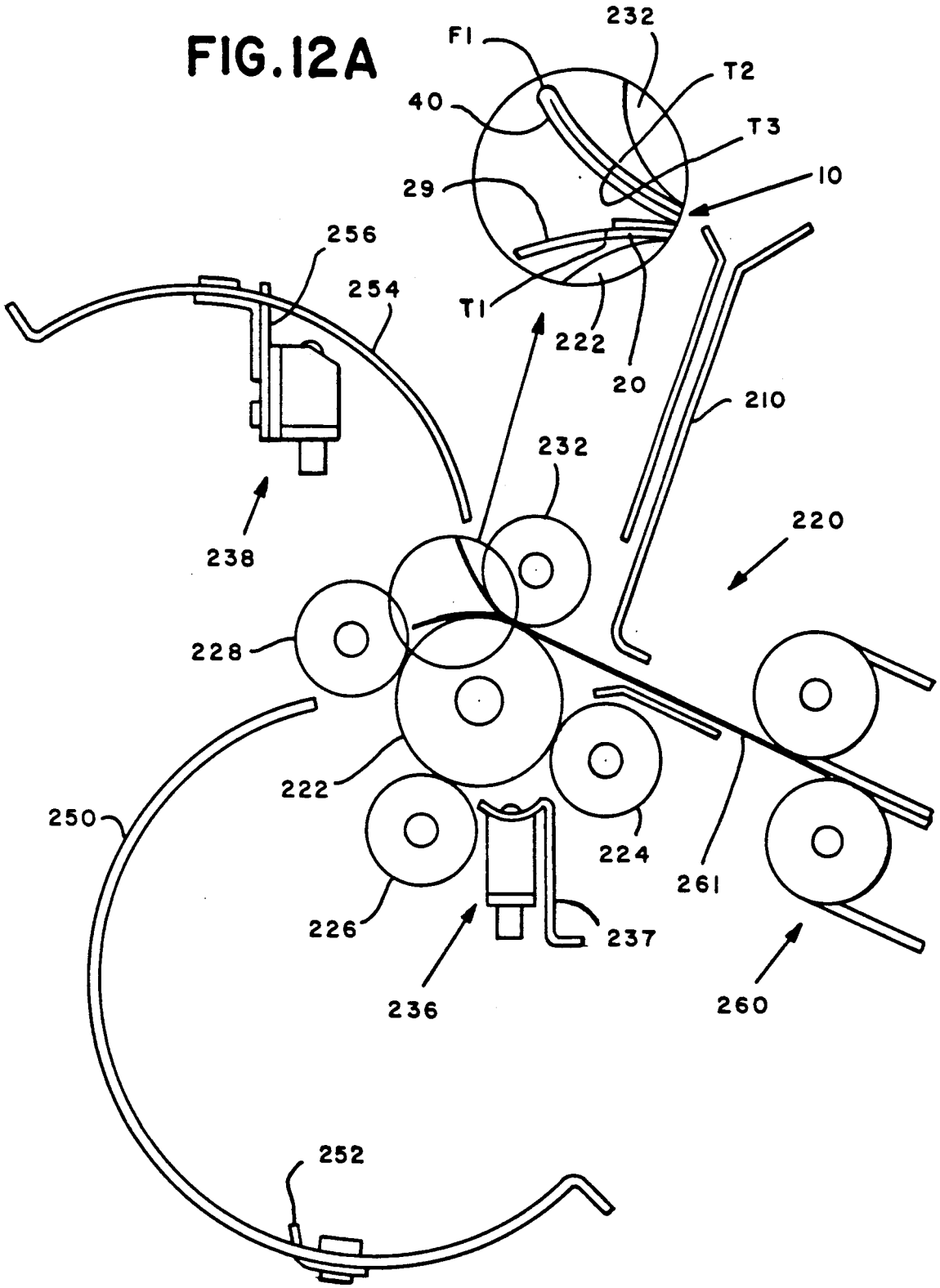

In FIGS. 12 and 12A form sheet 10 is urged along exit path 261 by roller 232. As can be seen in the detail, connecting portion 40, which has been moistened, is brought into contact with adhesive 29 along the trailing lateral edge of upper portion 20 and tear lines T1, T2, and T3 are aligned.

Figure 13:
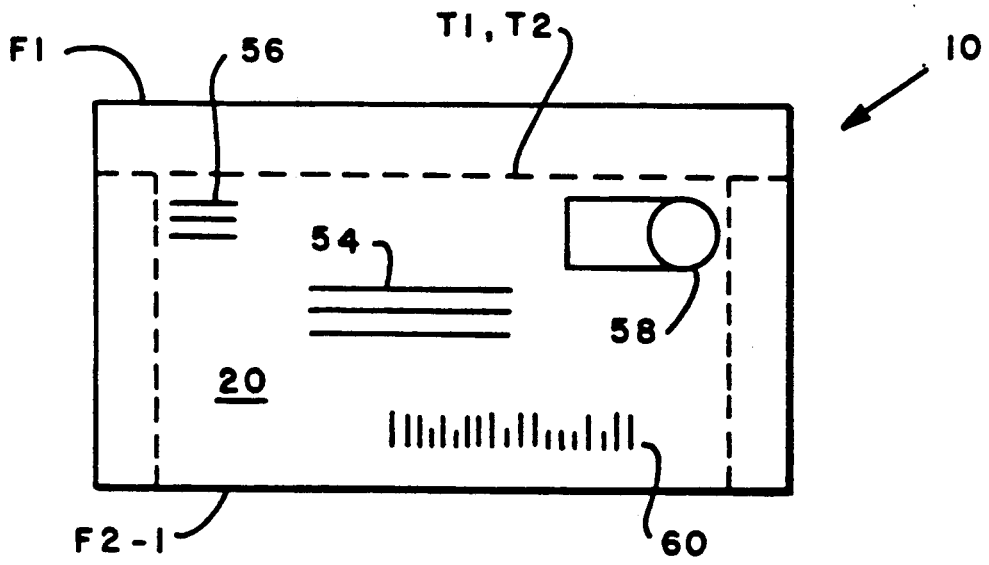
FIG. 13 shows the form sheet of FIGS. 1 and 2 after final folding and sealing.

FIG. 13 shows form sheet 10 as folded and sealed to form a self-mailer.

Figure 15:
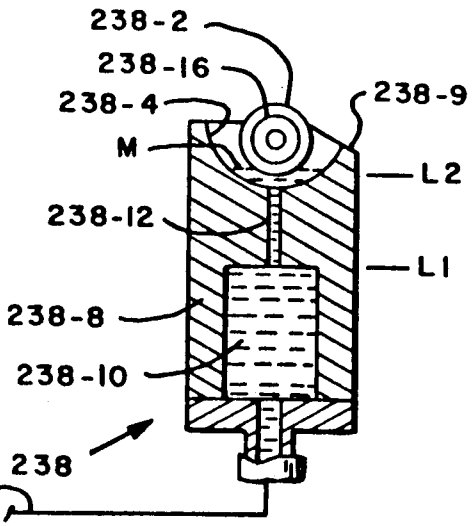
FIGS. 14 and 15 show a moistening apparatus useful with apparatus in accordance with the subject invention.
Figure 15:
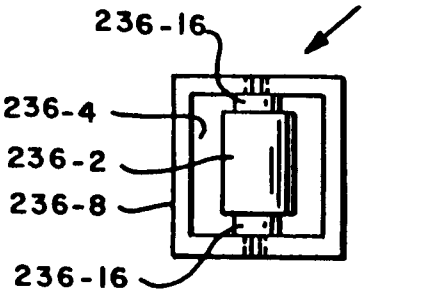
Figure 14:
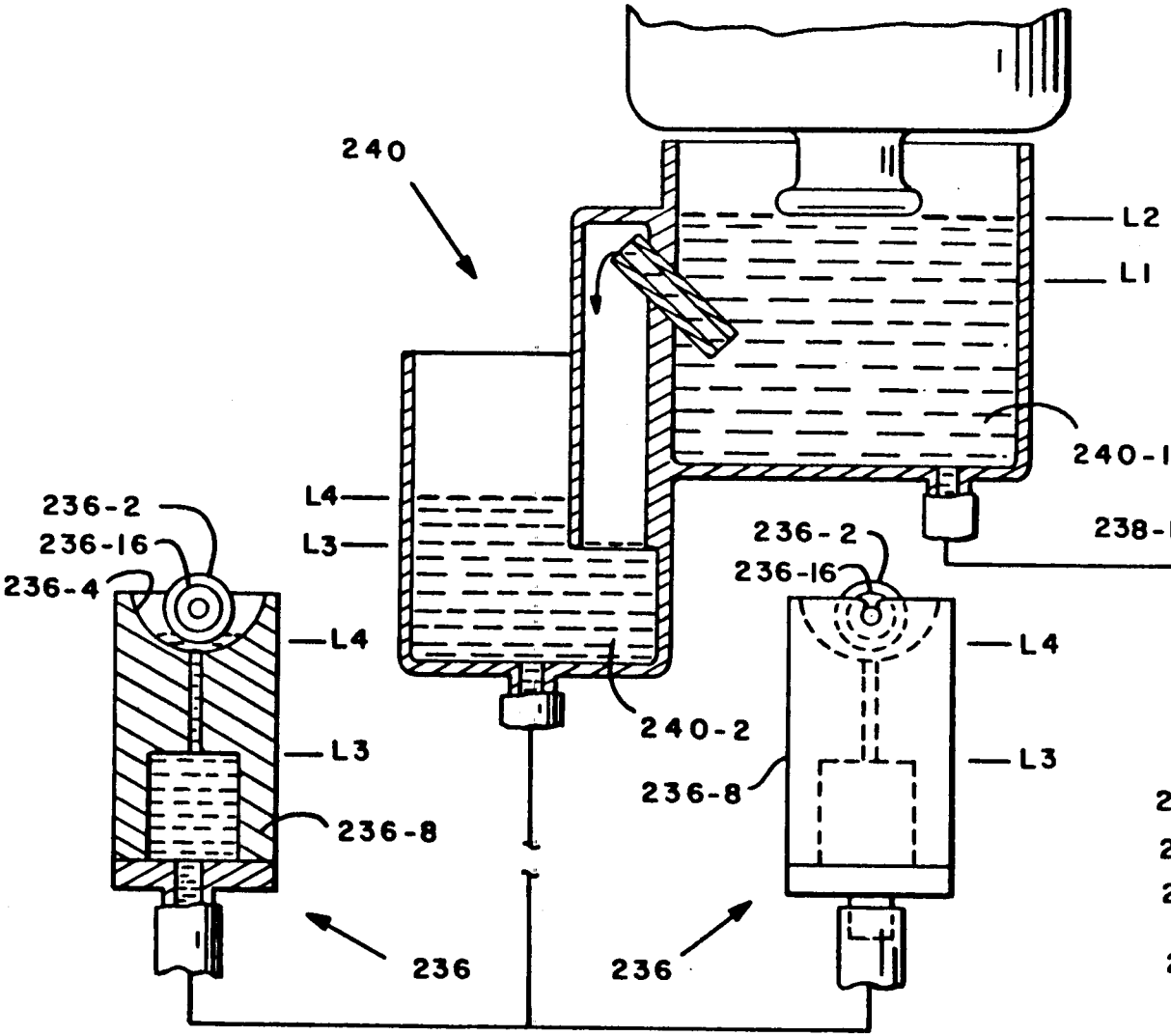

FIGS. 14 and 15 show a schematic representation of the moistening system of the preferred embodiment of the subject invention. As described in the above cited U.S. Pat. No. 2,374,076, fluid supply system 240 maintains two reservoirs 240-1 and 240-2 for supplying moistening apparatus 238 and 236 respectively. As shown, reservoir 240-1 will vary between levels L1 and L2, while reservoir 240-2 will vary between levels L3 and L4.

Moistening apparatus 238 is connected to reservoir 240-1 by fluid supply tubing 238-1. Apparatus 238 comprises a smooth metal roller 238-2 mounted in a trough 238-4 provided in the top of body 238-8. The length of roller 238-2 and 238-4 is substantially equal to the width of connecting portion 40 of form sheet 10 and a bevel 238-9 is provided in body 238-8 to facilitate moistening of connecting portion 40 as form sheet 10 is withdrawn from buckle chute 254 as shown in FIG. 11. Body 238-8 also contains primary reservoir 238-10 which is connected to trough 238-4 by capillary tube 238-12. Capillary tube 238-12 is approximately 0.060 inches wide and extends substantially for the full length of trough 238-4. Reservoir 240-1 is so designed and positioned that level L1 is sufficiently high that primary reservoir 238-10 is maintained full and the length of capillary 238-12 is chosen with respect to level L2 so that level L2 is approximately at or below the bottom of trough 238-4.

Thus, meniscus of water M is maintained at a substantially constant level in the bottom of trough 238-4 to moisten roller 238-2. As form sheet 10 moves across roller 238-2 the roller rotates through meniscus M and picks up a substantially continuous sheet of water to moisten connecting portion 40. It has been found that it is desirable to reduce the diameter of roller 238-2 as much as is practicable in order to assure a smooth continuous sheeting action of the water picked up by roller 230-2 from meniscus M. The lower limits of this diameter result from the need to assure a smooth continuous rotation of roller 238-2 as form sheet 10 passes across it. If the diameter becomes too small, the rotation becomes irregular and moistening is adversely affected. Diameters of between approximately 0.12 and 0.25 inches, and preferably approximately 0.19 inches, have been found to be effective. The gap between roller 238-2 and trough 238-4 widens from approximately 0.03 inches, at the bottom, to approximately 0.125 inches so as to prevent capillary action causing trough 238-4 to overflow.

FIG. 14 also shows moistening apparatus 236 which are provided to moisten adhesive 29 along the lateral edges of upper portion 20. These apparatus are positioned with respect to levels L3 and L4 of reservoir 240 in the same manner as moistening apparatus 238 is positioned with respect to levels L1 and L2 and are substantially identical to apparatus 238. They differ only in that body 236-8 does not include a bevel and in having a shorter length, and need not be discussed further here for an understanding of the subject invention.

FIG. 15 shows a top view of moistening apparatus 236. As can be seen, roller 236-2 is mounted in trough 236-4 provided in body 236-8, as described above. Hubs 236-16, approximately 0.075 inches long, are provided to prevent capillary action between the ends of roller 236-2 and the ends of trough 236-4 which, if it occurred, might cause overflow of trough 238-4. Similar hubs 238-16 are provided in apparatus 238.

The above embodiments of the subject invention have been described by way of illustration only, and other embodiments of the subject invention will be apparent to those skilled in the art from consideration of the detailed description given above and the attached drawings. Accordingly, limitations on the subject invention are to be found only in the claims set forth below.

What is claimed is:

1. Apparatus for folding and sealing a form sheet along a transverse edge comprising:
(a) folding means for folding said form sheet so that leading and trailing edges of said form sheet are superimposed and in contact, said folding means including a curved, one-sided buckle chute, open towards its concave side; and,
(b) sealing means for applying adhesive fluid to a portion of said form sheet adjacent said leading transverse edge; wherein,
(c) said sealing means is positioned in relation to said concave side and the stop of said buckle chute so that said form sheet bypasses said sealing means as it enters said buckle chute and touches said sealing means as it is withdrawn, whereby said adhesive fluid is applied to said portion without activation or displacement of said sealing means.

2. An apparatus as described in claim 1 wherein a remoistenable glue is applied to said form sheet and said adhesive fluid is water for remoistening said glue.

3. An apparatus as described in claim 2 wherein said glue is applied to an area adjacent the trailing transverse edge of said form sheet and said water is applied to a corresponding area adjacent said leading edge.

4. An apparatus as described in claim 3 wherein said sealing means applies said adhesive fluid as said form sheet is withdrawn from said buckle chute.

5. Apparatus as described in claim 3 wherein said sealing means further comprises:
(a) a primary reservoir;
(b) a roller positioned for tangential contact with said form sheet as said form sheet moves transversely across said roller,
(c) a trough substantially surrounding the lower portion of said roller and extending along the length of said roller,
(d) capillary means connecting said primary reservoir and said trough for maintaining a meniscus of water in said trough; wherein
(e) as said form sheet moves across said roller said roller rotates through said meniscus to transfer a film of water to said form sheet.

6. Apparatus as described in claim 2 wherein said sealing means further comprises:
(a) a primary reservoir;
(b) a roller positioned for tangential contact with said form sheet as said form sheet moves transversely across said roller,
(c) a trough substantially surrounding the lower portion of said roller and extending along the length of said roller,
(d) capillary means connecting said primary reservoir and said trough for maintaining a meniscus of water in said trough; wherein
(e) as said form sheet moves across said roller said roller rotates through said meniscus to transfer a film of water to said form sheet.

7. An apparatus as described in claim 3 wherein said sealing means applies said adhesive fluid as said form sheet is withdrawn from said buckle chute.

8. An apparatus as described in claim 2 wherein said sealing means applies said adhesive fluid as said form sheet is withdrawn from said buckle chute.

9. An apparatus as described in claim 1 wherein said sealing means applies said adhesive fluid as said form sheet is withdrawn from said buckle chute.

10. An apparatus as described in claim 1 wherein said folding means further comprises:
(a) a central roller
(b) an urge roller forming a nip with said central roller for transporting said form sheet into said buckle chute until said form sheet reaches said stop and a buckle form along a predetermined transverse line in said form sheet; and
(c) a fold roller forming a second nip with said central roller for capturing said buckle and folding said form sheet.

11. Apparatus as described in claim 10 wherein the circumference of said central roller is greater than the length of said form sheet after folding and sealing, whereby said leading edge will not interfere with said trailing edge.

12. Apparatus for folding and sealing a form sheet along a transverse edge comprising:
(a) folding means for folding said form sheet so that the leading and trailing edges of said form sheet are superimposed and in contact, said folding means including a curved, one-sided buckle chute, open towards its concave side; and,
(b) sealing means, positioned adjacent to said concave side and the stop of said buckle chute for applying adhesive fluid to a portion of said form sheet adjacent said leading transverse edge; wherein,
(c) a remoistenable glue is applied to said form sheet and said adhesive fluid is water for remoistening said glue; and,
(d) said sealing means further comprises:
(d1) a primary reservoir;

(d2) a roller positioned for tangential contact with said form sheet as said form sheet moves transversely across said roller, (d3) a trough substantially surrounding the lower portion of said roller and extending along the length of said roller, (d4) capillary means connecting said primary reservoir and said trough for maintaining a meniscus of water in said trough; wherein, (d5) as said form sheet moves across said roller said roller rotates through said meniscus to transfer a film of water to said form sheet.

13. An apparatus as described in claim 12 wherein said glue is applied to an area adjacent the trailing transverse edge of said form sheet and said water is applied to a corresponding area adjacent said leading edge.

14. Apparatus for folding and sealing a form sheet along a transverse edge comprising:

(a) folding means for folding said form sheet so that the leading and trailing edges of said form sheet are superimposed and in contact, said folding means including a curved, one-sided buckle chute, open towards its concave side; and, (b) sealing means, positioned adjacent to said concave side and the stop of said buckle chute for applying adhesive fluid to a portion of said form sheet adjacent said leading transverse edge; wherein, (c) said folding means further comprises:

(c1) a central roller (c2) an urge roller forming a nip with said central roller for transporting said form sheet into said buckle chute until said form sheet reaches said stop and buckle form along a predetermined transverse line in said form sheet; and (c3) a fold roller forming a second nip with said central roller for capturing said buckle and folding said form sheet; and wherein, (d) the circumference of said central roller is greater than the length of said form sheet after folding and sealing, whereby said leading edge will not interfere with said trailing edge.

* * * * *

UNITED STATES PATENT AND TRADEMARK OFFICE

CERTIFICATE OF CORRECTION

PATENT NO. : 5,006,195

DATED : April 9, 1991

INVENTOR(S) : Samuel W. Martin, et al.

It is certified that error appears in the above-identified patent and that said Letters Patent is hereby corrected as shown below:

Add the drawing sheets consisting of FIGS. 3 and 4, as shown on the attached pages.

Signed and Sealed this

First Day of March, 1994

Bruce Lehman

*Attest:*

BRUCE LEHMAN

*Attesting Officer*

*Commissioner of Patents and Trademarks*